United States Patent [19]

Gutmann, Jr. et al.

[11] 3,964,401

[45] June 22, 1976

[54] TYPEWRITER AND BOOKKEEPING MACHINE WORK UNIT FOR THE FORMATION OF A WORK UNIT CHAIN

[75] Inventors: Karl Gutmann, Jr., Unterkirnach; Rupert Eder, Villingen, both of Germany

[73] Assignee: Firma Karl Gutmann KG, Germany

[22] Filed: June 25, 1971

[21] Appl. No.: 156,915

[30] Foreign Application Priority Data

June 25, 1970 Germany ..... 2031450
Mar. 10, 1971 Germany ..... 2111419

[52] U.S. Cl. ..... 108/64; 312/194; 312/198

[51] Int. Cl.[2] ..... A47B 57/00; A47B 17/00

[58] Field of Search ..... 108/64, 60, 69; 312/196, 194, 197

[56] References Cited

UNITED STATES PATENTS

| | | | |
|---|---|---|---|
| 12,497 | 3/1855 | Woodcock | 312/198 |
| 1,585,102 | 5/1926 | Langdon | 312/198 X |
| 1,668,072 | 5/1928 | Hearne | 108/64 |
| 2,489,933 | 11/1949 | Schwarz | 108/64 |
| 2,545,253 | 3/1951 | Bergson | 312/195 X |
| 2,694,614 | 11/1954 | Dent | 312/198 X |
| 2,746,825 | 5/1956 | Lee | 312/194 X |
| 2,821,450 | 1/1958 | Knoll | 312/198 X |
| 2,857,223 | 10/1958 | Furey | 108/64 |
| 2,928,703 | 3/1960 | Paulsen | 312/194 X |
| 2,930,665 | 3/1960 | Budai | 312/198 X |
| 3,082,712 | 3/1963 | Trautmann et al. | 108/64 UX |
| 3,253,870 | 5/1966 | Stanton et al. | 312/195 X |
| 3,339,503 | 9/1967 | Flodell | 108/64 X |
| 3,533,362 | 10/1970 | Thompson | 108/64 |

*Primary Examiner*—Paul R. Gilliam
*Assistant Examiner*—Victor N. Sakran
*Attorney, Agent, or Firm*—McGlew and Tuttle

[57] ABSTRACT

Each work unit includes a main table, for supporting a typewriter or a bookkeeping machine, and a side table extending laterally from the main table. Each table has a frame, and the frames of the two tables of each unit are disengageably interconnected. The main table has a pair of longer sides and a pair of shorter sides, and the associated side table is disengageably connected to one shorter side of the associated main table, with the main tables extending alternately to the right and to the left from the chain of work units. The side tables have their shorter edges interconnected with each other to form the work unit chain. The table tops may be adjustably mounted on their supporting frames so as to be adjustable in height or tiltable, and auxiliary shelves may be provided beneath the side tables. Additionally, each side table may support a box-shaped attachment to form a storage recess or the like.

16 Claims, 9 Drawing Figures

INVENTORS
Karl GUTMANN
Rupert EDER

By John J. McGlew their ATTORNEY

INVENTORS
Karl GUTMANN
Rupert EDER

By John A. McGlew their ATTORNEY

INVENTORS
Karl GUTMANN
Rupert EDER

By John J. McGlew their ATTORNEY

INVENTORS
Karl GUTMANN
Rupert EDER

By John J. McGlew their ATTORNEY

INVENTORS
Karl GUTMANN
Rupert EDER

By John J. McLau their ATTORNEY

INVENTORS
Karl GUTMANN
Rupert EDER

By John J. McGlew their ATTORNEY

INVENTORS
Karl GUTMANN
Rupert EDER

By John P. McGlew their ATTORNEY

INVENTORS
Karl GUTMANN
Rupert EDER

By John O. McGlew their ATTORNEY

TYPEWRITER AND BOOKKEEPING MACHINE WORK UNIT FOR THE FORMATION OF A WORK UNIT CHAIN

FIELD OF THE INVENTION

This invention relates to chains of work units for typewriters or bookkeeping machines extending from opposite sides of a table band and, more particularly, to a novel and improved work unit chain which is readily and easily adapted to various layouts.

BACKGROUND OF THE INVENTION

Such work unit chains are used primarily in large offices and in schoolrooms, where it is important to arrange as many work places and training places, for typewriters or bookkeeping machines, as possible in the existing available space.

In the present design of these work unit chains, the table band has usually been manufactured separately and assembled, as a whole, in correspondence to the available length, after which the individual typewriter or bookkeeping machine tables have been arranged to extend to the left or to the right from the table band at selected intervals and, if necessary, secured either on the floor of the respective room or to the table band. Known workpiece units have the disadvantage that they are specifically planned for a certain room, and do not permit any variations in the layout. In addition, these work unit chains are expensive, since they are practically always custom made and, since they are designed for a certain room, must be redesigned for each new location.

SUMMARY OF THE INVENTION

The object of the present invention is to eliminate these disadvantages and to provide a work unit of a nature such that any number thereof can be assembled to form a work unit chain for various uses, so that the planning and assembly costs are considerably reduced, and so that it is possible to use the typewriter and bookkeeping machine tables furthermore in a vertically adjustably form.

The present invention is particularly characterized in that each work unit consists of a typewriter or bookkeeping machine main table and of a side table extending laterally from the main table, the base of the side table being detachably connected with the base of the associated main table. This has many advantages. For example, both the typewriter and bookkeeping machine tables and the side tables can be prefabricated and delivered separately, by the manufacturer, to the place where they are to be installed. Each typewriter or bookkeeping machine table has assigned thereto a fixed place on the table band.

The typewriter or bookkeeping machine table, and the associated side table, can be easily set up on the spot, corresponding to the preceding simplified planning or to the existing space, and several of the units can be assembled to form a work unit chain.

Since the bases of the side tables and the main tables are connected with each other, this provides the necessary stability of the work unit and, in addition, the table top of the typewriter or bookkeeping machine table can be adjusted in height, can be tilted independently of the top of the side table, or both.

As a further feature of the invention, it is provided that the side tables are arranged alternately on the left and right narrower sides of their associated typewriter or bookkeeping machine tables, and abut each other with their own narrower sides to be detachably interconnected with each other to form the table band.

The advantage thus attained is that the entire work unit chain is formed practically of a plurality of the individual complete work units, which provides many possibilities for variation in the formation of a work unit chain, and also provides for the possibility of disassembling the units at any time and reassembling them again in another layout. A particular advantage, according to another feature of the invention, is that the typewriter or bookkeeping machine table of each unit has, in a known manner, a vertically adjustable top.

In order to make the work unit, according to the invention, less expensive to produce and easier to assemble, in accordance with another feature of the invention the side table has a tubular steel frame with only one leg, whose bottom end is secured to a skid and whose top end carries a horizontal and preferably rectangular tubular steel frame to receive the table top. This feature also ensures the stability of each side table.

In addition to other advantageous features of the invention, which will be clear from the following description of embodiments of the invention, the following features of the invention are of importance.

Below the top of the tubular steel frame carrying the side table there is arranged, at its end, a second supporting frame to receive an intermediate bottom or shelf, which serves to hold dictating or transcribing machines. A particular advantage is that the intermediate bottom or shelf of the side table is mounted displaceably on the second supporting frame, which facilitates substantially the operation of the machine arranged on the shelf, because the operator can then pull out the intermediate shelf, with the respective machine, from beneath the side table so that the machine is easier of access.

In order that a work unit embodying the invention can also be used in a so-called "language laboratory" it is desirable to provide the top of the side table with at least one cutout and, below the cutout, with supporting cross pieces to receive phonographs. Another advantageous possibility consists in that the top of the side table is provided with upright partitions and, due to these last two mentioned features of the invention, the work unit is capable of an additional use. It is naturally possible to attach subsequently the top of the side table, which is provided with a cutout and with supporting cross pieces for phonographs, on the respective supporting frame or to replace it by the standard side table top not having any cutout. The vertical partitions, which are necessary in language laboratories in order to shield acoustically the work places from each other, can also be attached subsequently at any time on the top of each side table.

A further very important feature of the invention is that the top of each typewriter or bookkeeping machine table is tiltable. This facilitates the work of handicapped people in such a work place. It is immaterial, particularly when the table top is at the same time also vertically adjustable, whether the frame carrying the table top is mounted tiltably or whether the table top is mounted to be tilted relative to its supporting frame.

In order further to simplify and to reduce the costs of the individual work units, to be assembled to form a work unit chain, as well as to improve them functionally, in accordance with another embodiment of the invention, that part of the table band associated with a table arranged laterally of the table band is a part of the respective table in the form of an extension of the table top. This has the advantage that the formation of a work unit chain is effected by arranging the individual side tables so that they overlap by the width of the table band to be formed. It is possible to connect the individual tables with each other by screw type joints, and each table can be provided with the number of legs necessary for good stability so that it can also be used as a single work place.

A particular advantageous design, with respect to this embodiment, consists in that the extension of the table top is arranged, on either the front or the rear side, in a table on the left and another table on the right, as a rectangular extension of the width of the table band. Thereby, considerable space is saved as well as material, while maintaining the necessary spacing between tables arranged in series on one side of the table band. In addition, this arrangement is advantageous for use of the respective table as a single work unit.

Another very important feature of the invention is that a part of each table, forming the table band, may be provided with a box-shaped attachment open on at least one side and which is flush with the edges of the table. This attachment forms, on the one hand, a hollow space open to the user for the accommodation of a dictating machine, etc. Since, in the formation of the work unit chain in accordance with the invention, as mentioned above, the left and right tables are staggered longitudinally of the chain to be formed, the surface of the box-shaped attachment can be used by the person sitting on the other side of the table band as a deposit area or as a working surface for handwriting. This assures, at the same time, the correct height for manual work. The table top height of the typewriter or bookkeeping machine tables is lower, as is known, than that of a normal desk. It is thus possible to provide a higher working surface by means of the box-shaped attachment.

In order to facilitate, for the person sitting next to the respective table, the change between the associated table and the higher working surface of the table band, which is part of the table next to it, it is important that one leg on the wider side of the table is arranged at the outer front corner and the other in the rear inner corner of the table band. This has the effect that none of the table legs is in the way when the person sitting on the other side of the widened front of the respective table turns from the machine, standing on the lower table top, to the higher working surface, or vice versa. On the narrower side, the table can be provided with two legs arranged at the corners, or with one leg arranged centrally and extending upwardly from a horizontal skid. Due to this arrangement of the legs, the necessary freedom for the operator's legs is attained, on the one hand, while, on the other hand, the table nevertheless is very stable.

An object of the invention is to provide an improved work unit, for typewriter or bookkeeping machines, forming part of a work unit chain.

Another object of the invention is to provide such a work unit including a main table, for supporting a typewriter or bookkeeping machine, and a side table extending laterally from the main table.

A further object of the invention is to provide such a work unit in which each table has a frame and the frames of the two tables of each unit are disengageably interconnected.

Another object of the invention is to provide such a work unit in which a series of side tables can be joined together in end-to-end relation to form the table band.

For an understanding of the principles of the invention, reference is made to the following description of typical embodiments thereof as illustrated in the accompanying drawings.

DESCRIPTION OF THE PREFERRED EMBODIMENTS

Figure 1:
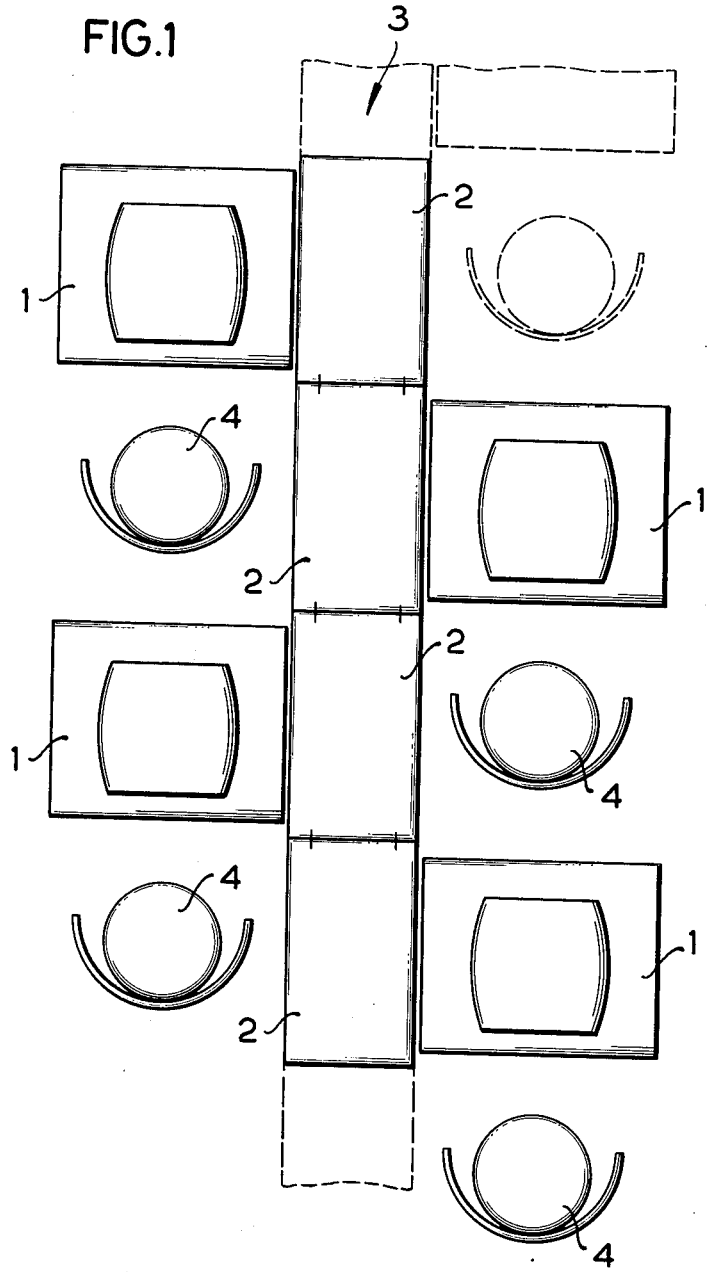
FIG. 1 is a top plan view of a work unit chain consisting of a number of typewriter or bookkeeping machine work units in accordance with the invention.

Referring first to FIG. 1, the work unit chain or work place chain shown therein consists of four work places or work units, each of which has a main table 1, for a typewriter or a bookkeeping machine, and a side table 2. Side tables 2 form a table band 3, since the shorter sides or ends of adjacent side tables 2 are connected with each other. A chair 4 is provided for each work place or work unit.

Figure 2:
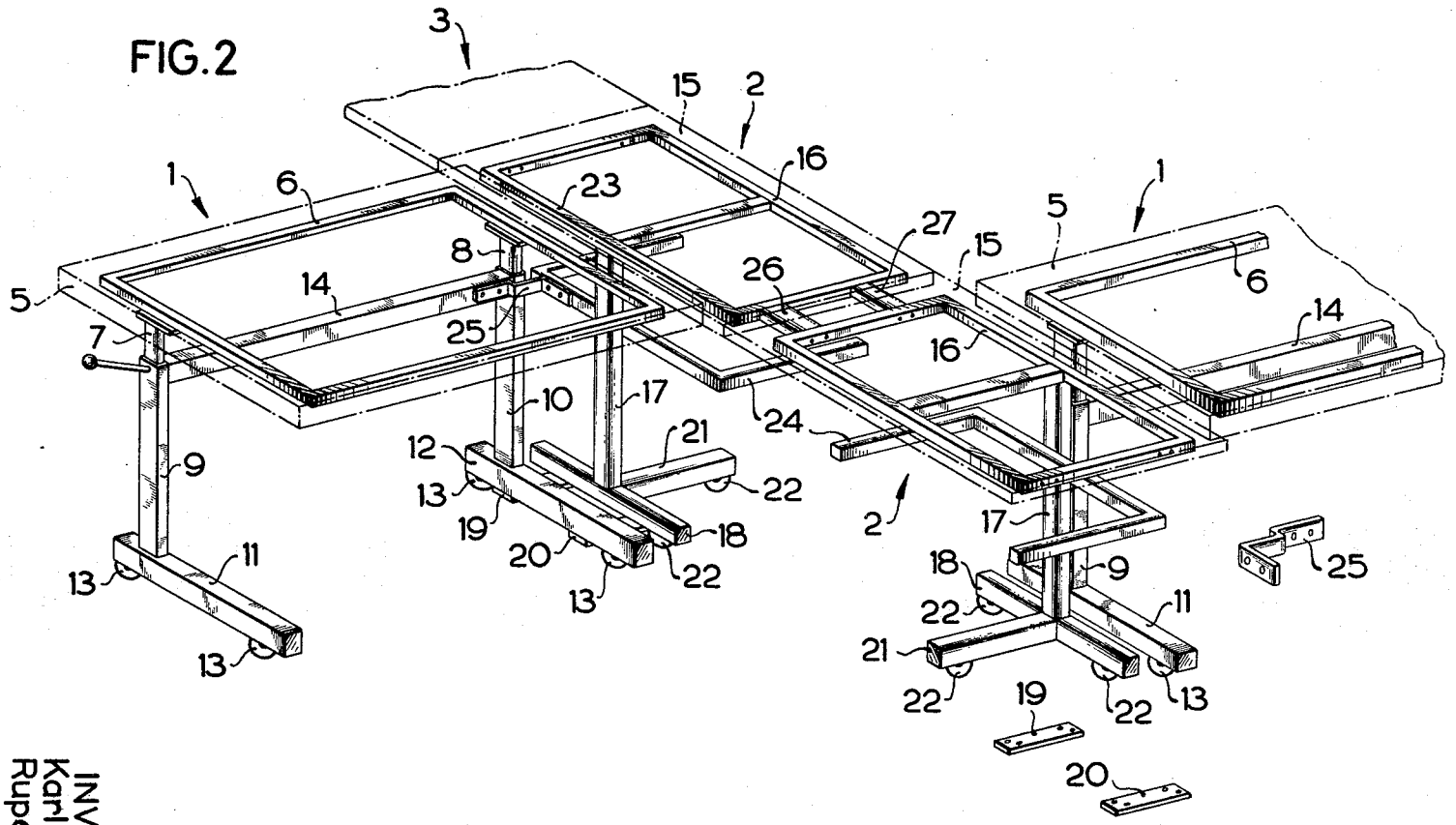
FIG. 2 is a perspective view of the arrangement of the bases of two work units forming part of a work unit chain.

As seen in FIG. 2, the tops 5 of the main tables 1, for supporting typewriters or bookkeeping machines, and indicated in FIG. 2 in broken lines, rest on a rectangular frame 6 which, in turn, is carried by two vertically adjustable columns 7 and 8 of the table base. Columns 7 and 8 are guided telescopically in respective legs 9 and 10, and are supported, in a known manner, by so-called gas air springs which compensate part of the weight of the table top. Legs 9 and 10 extend perpendicularly upwardly from the rear ends of respective skids 11 and 12 provided on their undersides with vertically adjustable legs 13, and a cross member or bar 14 interconnects the upper ends of legs 9 and 10.

Particularly for handicapped people, it is preferable either to secure frame 6 on columns 7 and 8 tiltably, for example, in the same manner as already known from drafting tables, or to arrange table top 5 tiltably on supporting frame 6, so that table top 5 can be set either alone or together with frame 6 at any desirable inclination within a certain angularly range.

The table top 15 of the side table, indicated in FIG. 2 in broken lines, is also supported on a horizontal tubular steel substantially rectangular frame 16 which, in FIG. 2, is welded onto a leg 17 which extends centrally upwardly from a skid 18 extending parallel to skid 12, and which is bolted to skid 12 through the medium of cross bars 19 and 20. Skid 21 forms, with skid 18, a T-shaped base which is provided with three vertically adjustable legs 22 and imparts a certain stability to side table 2 even when the latter is separate from main table 1.

Leg 17 of side table 2 is positioned vertically beneath that longer side 23 of frame 16 which is adjacent main table 1, and beneath frame 16 at a certain spacing therefrom, leg 17 supports a second supporting frame 24 to receive an intermediate bottom or shelf (FIGS. 4 and 5) on which can be placed, for example, a dictating machine or a transcribing machine.

Figure 5:
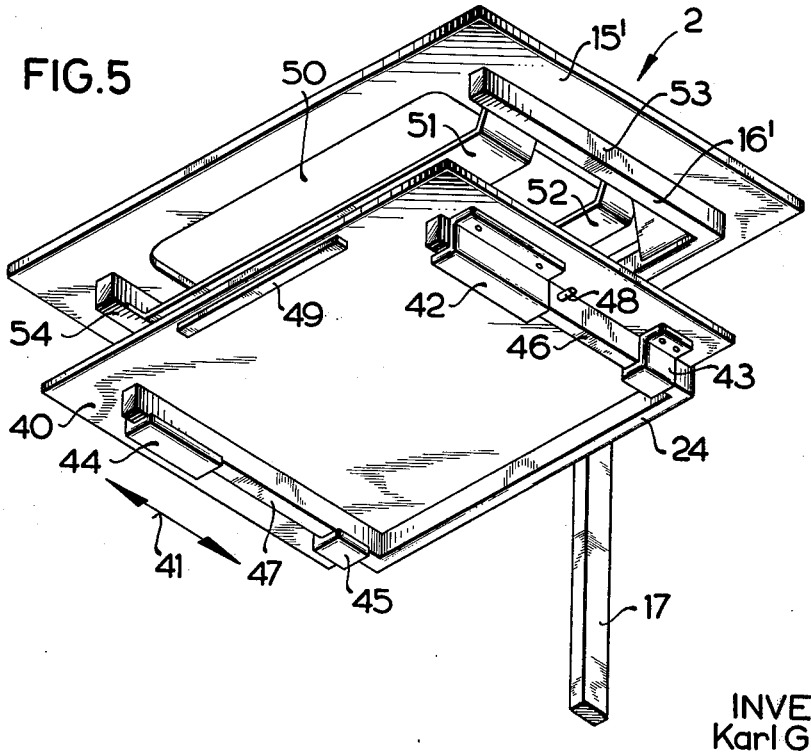
FIG. 5 is a perspective view, looking upwardly, of the side table shown in FIG. 4.

As seen particularly in FIG. 5, shelf 40 can be mounted for displacement on the forked supporting frame 24 in the direction of the double arrow 41. For this purpose, angle plates 42, 43, 44 and 45 are secured on the undersurface of the intermediate shelf 40 at a certain spacing from each other, and extend beneath the arms 46 and 47 of frame 24. Between angle plates 42 and 43, arm 46 has secured thereon a locking pin 48 which limits displacement of shelf 40, at least to the front, when angle plate 43 strikes locking pin 48. The operator thus can pull shelf 40, with the dictating machine or transcribing machine arranged thereon, from beneath the table top 15 or 15' sufficiently far out that the machine is readily accessible. Beneath the front edge of shelf 40, there is arranged a gripping bar 49.

Figure 4:
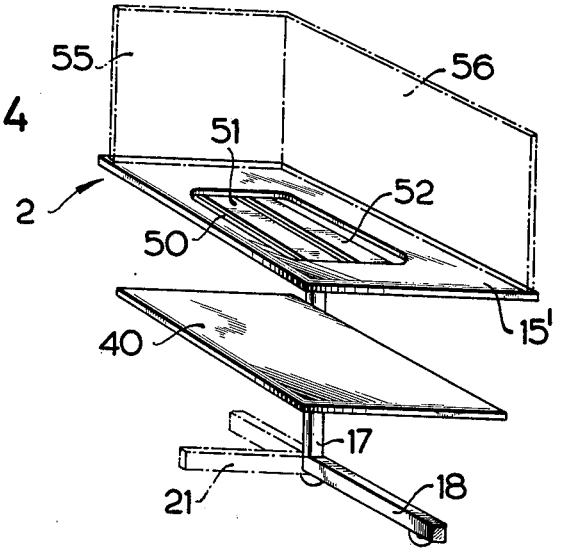
FIG. 4 is a perspective view of a side table.

In the embodiment showns in FIGS. 4 and 5, table top 15' of side table 2 is provided with a cutout 50 into which there can be set, for example, the lower part of a phonograph which can be placed on supporting bars 51 and 52 arranged beneath cutout 50 and secured to extend from arms 53 and 54 of supporting frame 16' which, in this embodiment, is open at the front.

As indicated in FIG. 4 by broken lines, table top 15' of side table 2 can also be provided with upright partitions 55 and 56. Such partitions serve to shield one work unit acoustically from the other, when the work unit is to be used, for example, in a language laboratory, where table top 15', provided with cutout 50 and the supporting frame 16', with supporting bars 51 and 52, are also used.

Referring again to FIG. 2, in addition to connecting straps or bars 19 and 20, which interconnect skids 12 and 18, the frame of side table 2 is connected by a connecting piece 25 to the frame of main table 1, connecting piece 25 being bolted to bar 14, on the one hand, and to supporting frame 24, on the other hand. The shorter ends of two tubular steel frames 16 of side tables 2 which abut with each other are interconnected by connecting pieces 26 and 27, which may be disengaged if desired.

For reasons of clarity, the typewriter or bookkeeping table 1 of FIG. 2, to the right of table band 3, is represented at a somewhat greater spacing from its side table 2. After the final assembly, it is connected by means of separately illustrated side straps 19 and 20 and connecting part 25 with its side table 2 in the same way as described and shown for the other main table 1 and associated side table 2.

It will be clear from FIG. 2 that work units assembled in the illustrated manner to form a work unit chain provide a more stable arrangement, and that the side tables can be arranged both to the left and to the right of the typewriter or bookkeeping machine tables 1.

Figure 3:
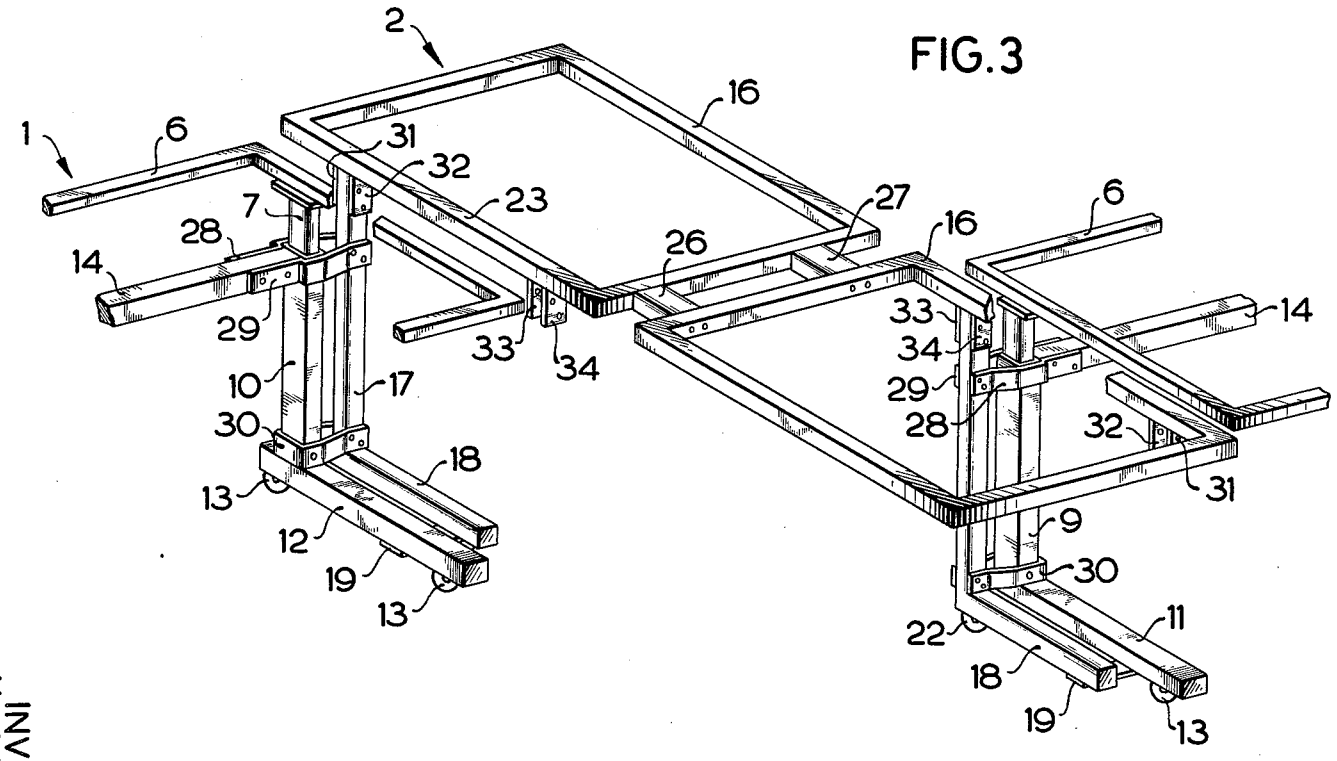
FIG. 3 is a view, generally similar to FIG. 2, illustrating a different embodiment of the bases or frames of the side tables.

In FIG. 3, identical parts are provided with the same reference characters as in FIG. 2. The frames of the tables 1 are shown only partially, for the sake of clarity, but so far as necessary for understanding. As compared to FIG. 2, only the bases of side tables 2 are designed differently. In this embodiment of the invention, the leg 17 of a side table 2 is not arranged at the center of the longer side 23 of the frame 16, but is so displaced towards one end of the frame 16 that it is exactly opposite the adjoining leg 10 of the typewriter or bookkeeping table 1 when supporting frame 16, or its table top, are arranged exactly aligned centrally with the narrow side of a typewriter or bookkeeping machine table 1. In addition, leg 16 does not stand centrally on skid 18, but extends upwardly from one end of the skid and is detachably connected, at the top by connecting pieces 28, 29 and at the bottom by a substantially U-shaped connecting piece 30, with the leg 10 of table 1.

Connection of the upper end of leg 17 with tubular steel frame 16 of side table 2 is effected by two side bars or plates 31, 32 which are welded on the underside of the longer edge 23 and spaced apart a distance corresponding to the thickness of leg 17 to which they are bolted. Symmetrically with side bars 31 and 32, there are arranged, on the same longitudinal side 23 of tubular frame 16, two additional side bars 33 and 34 so that, when the table 1 is arranged on the right side of the side table 2, leg 17 can be secured again in the same manner to frame 16 so that it extends parallel and adjacent to the corresponding leg 9 of table 1 on the right. In this embodiment also, skid 18 is provided with a vertically adjustable standing leg 22, so that the height of the skid 18 can be set to the height of the adjoining skid 11 or 12 of the respective table 1.

Instead of side bars 31, 32, 33 and 34 welded on steel frame 16, leg 17 can also be secured on frame 16 by angle plates or similar means, which can be bolted both to the upper end of leg 17 and to frame 16. When the necessary threaded bores are provided on the corresponding points of frame 16, that is, on one of the longer legs 23, only two angle plates are required instead of the four side bars 31–34.

In the embodiment illustrated in FIG. 3, skid 21 is eliminated and skids 12 and 18, and 11 and 18, respectively, are connected with each other only by one strap 19 which can be bolted to both. In this embodiment also, the tubular steel frames of two adjoining side tables 2 are bolted to each other by connecting pieces 26 and 27 so as to form two members of a work unit chain, the side tables 2 forming a table band between the staggered typewriter or bookkeeping machine tables 1.

While the side tables 2, in the embodiment of FIG. 3, can be used only with the associated typewriter or bookkeeping machine tables 1, the side tables illustrated in FIG. 2 can additionally be used separately. For forming a work unit chain, the side tables of the embodiment of FIG. 3 have the advantage that they are simpler and less expensive, while nevertheless assuring the same stability of the work units.

Figure 6:
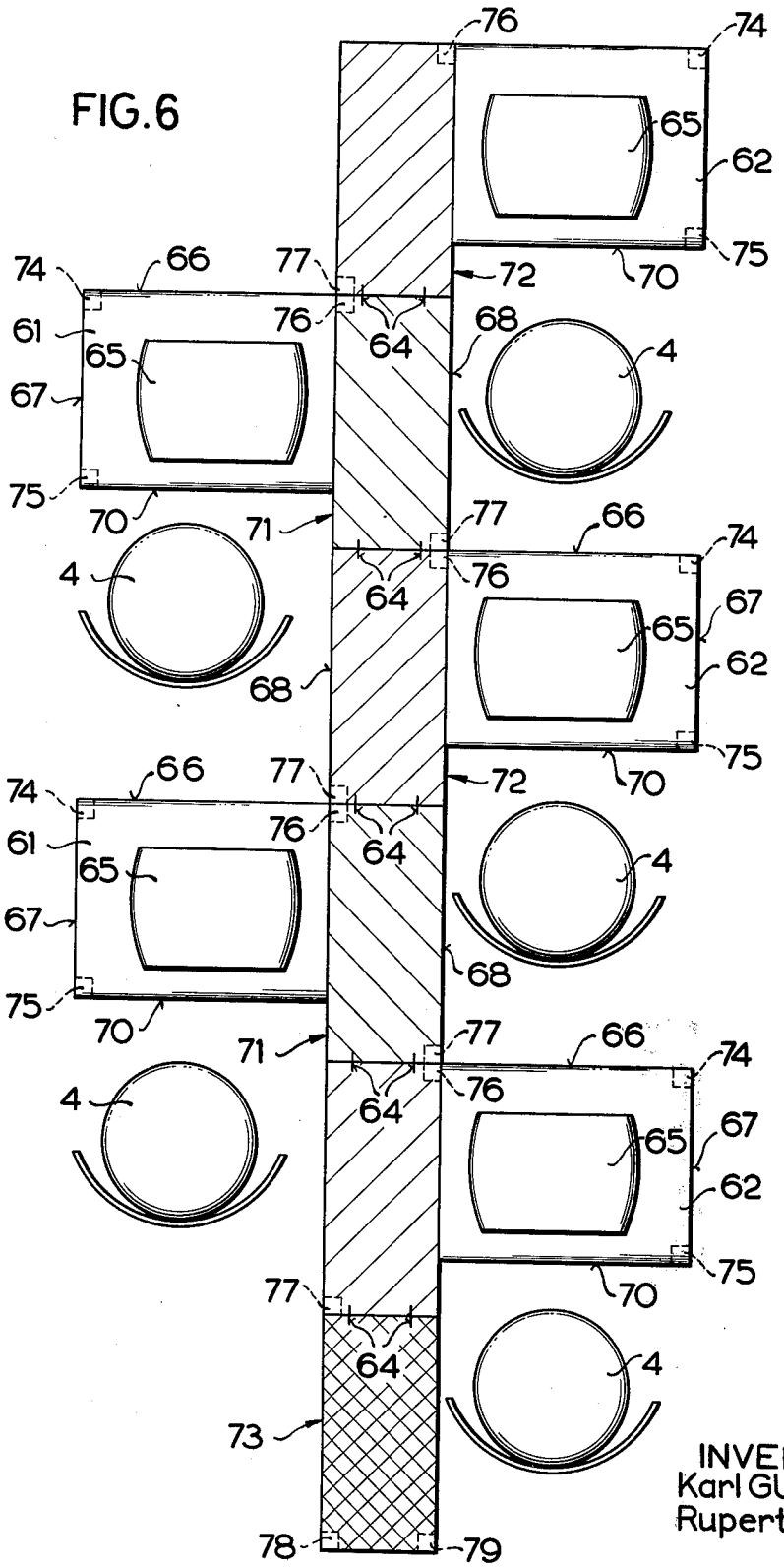
FIGS. 6 and 7 are top plan views of two different embodiments of work unit chains in accordance with the invention.

The work unit chain illustrated in FIG. 6 comprises two leftward extending work units 61 and three rightward extending work units 62, with the chairs for the respective work units being positioned in the longitudinal spaces between the work units. The leftward extending units 61 and the rightward extending units 62 are so staggered that the hatched areas form a central table band and, at the points indicated at lines 64, the leftward extending units 61 are bolted to the rightward extending units 62 to form the table band. It will also be noted that the hatched areas of the table band portions of the rightward extending units 62 are assigned to the users of the leftward extending units 61, and vice versa. The clear or unhatched areas of the units 61 and 62 are the supports for the typewriters or bookkeeping machines 65. In both the units 61 and 62, each rear edge 66 extends as a straight line from the narrow outer end edge 67 to the opposite end edge 68, and a rectangular extension 71, 72 extends from the front edges 70 of all the machine supporting tables and forms part of the associated hatched table band area. In the leftward extending units 61, the extensions 71 are to the right while, in the rightward extending units 62, the extensions 72 are to the left. The bottom righthand seat 4, as viewed in FIG. 6, has associated therewith an extension element 73 indicated by cross hatching.

While the legs 74 and 75 on the narrow ends 67 of all the units 61 and 62 can be arranged, as usual, at the corners of the unhatched table area or in any other way, the legs 76 and 77 are arranged in a special manner. Thus, legs 76 are arranged at the rear inner corners of the table band areas, while legs 77 are arranged in the front outer corner of these areas. This arrangement assures, on the one hand, the necessary freedom for an operator's legs under the table tops and permits, on the other hand, in addition to the bolted connections indicated by line 64, the connection of leg 77 of one unit to the leg 76 of the adjoining unit. Despite the staggered arrangement of the legs 76, 77, each unit, even if it is used as a single work unit, is very stable. Extension element 73 has two legs 78 and 79 at its outer end, and its inner end is bolted to the extension 72 of the adjacent rightwardly extending unit 62.

Figure 8:
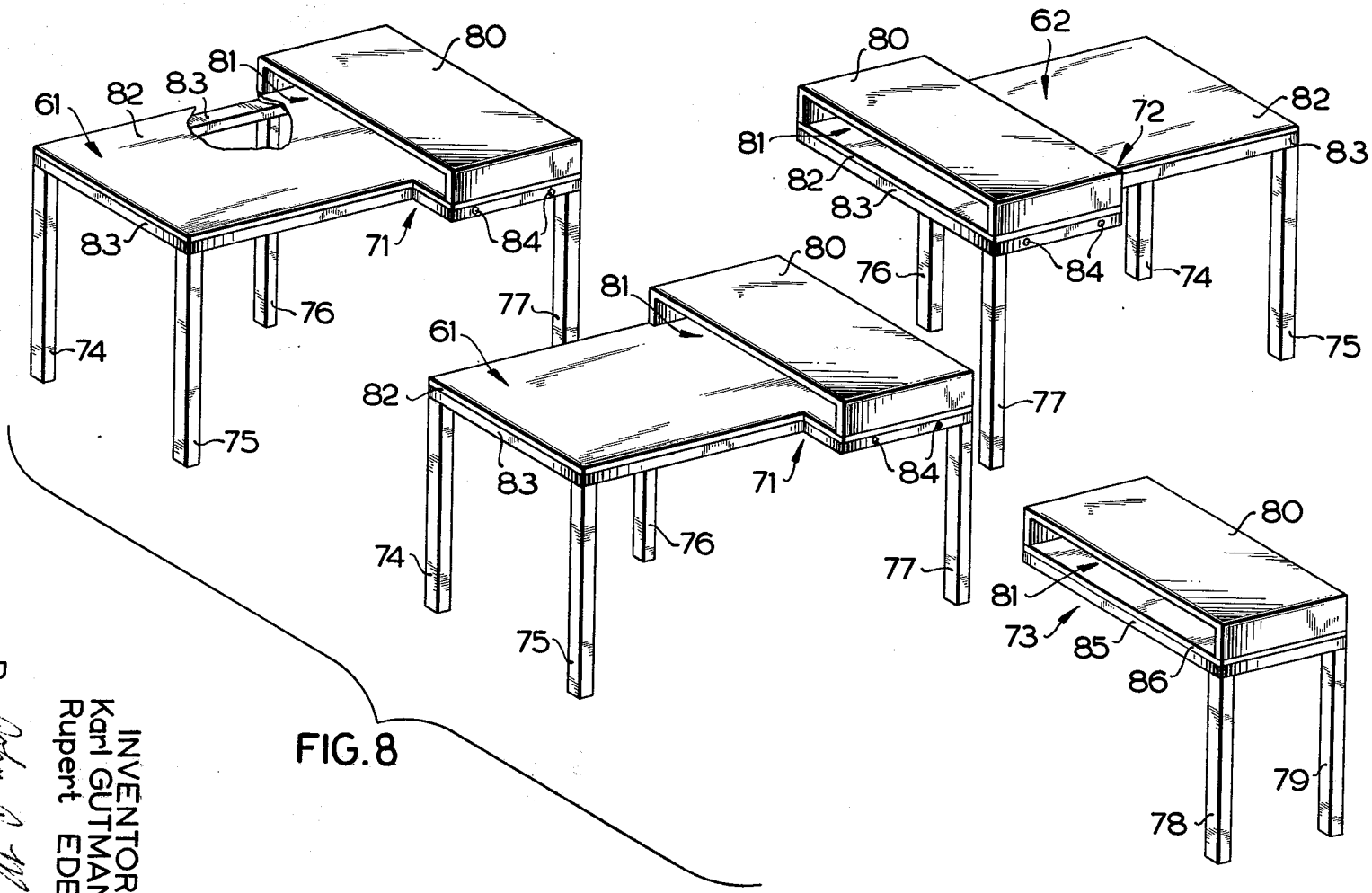
FIG. 8 is an exploded perspective view of the work unit chain shown in FIG. 6.

FIG. 8 illustrates two lefthand units 61 and one right hand unit 62, as well as the extension element 73. For reasons of clarity, the tables are spaced from each other, but it can be seen that the righthand unit 62 can be so inserted between two lefthand units 61 that the hatched areas of FIG. 6 align to form the table band. Both the tables 61 and the table 62, as well as extension elements 73, are provided with box-shaped attachments 80 each of which is as wide as the portion of the table indicated by the hatched area in FIG. 6, and each of which is flush with a rear edge 66, the front edge 68, and the end of the respective extension 71 or 72. These box-shaped attachments 80 of the individual units 61 and 62, as well as of extension element 73, form cavities or recesses 81 in which can be placed, for example, a dictating machine, etc. Preferably, attachments 80 are disengageably mounted. The hatched surfaces of attachments 80 form additional elevated working surfaces for handwriting, etc., and are assigned to the user of the work unit on the opposite side of the table band.

The table tops 82 of the individual units 61 and 62 are secured on horizontal tubular metal frames 83, which are generally L-shaped in plan in view of the extensions 71 and 72. Bores are provided at suitable locations along the metal frames to receive the connecting screws or bolts. Extension element 73 has a rectangular metal frame 85 on which rests a table top 86 which carries the box-shaped attachment 80.

Figure 7:
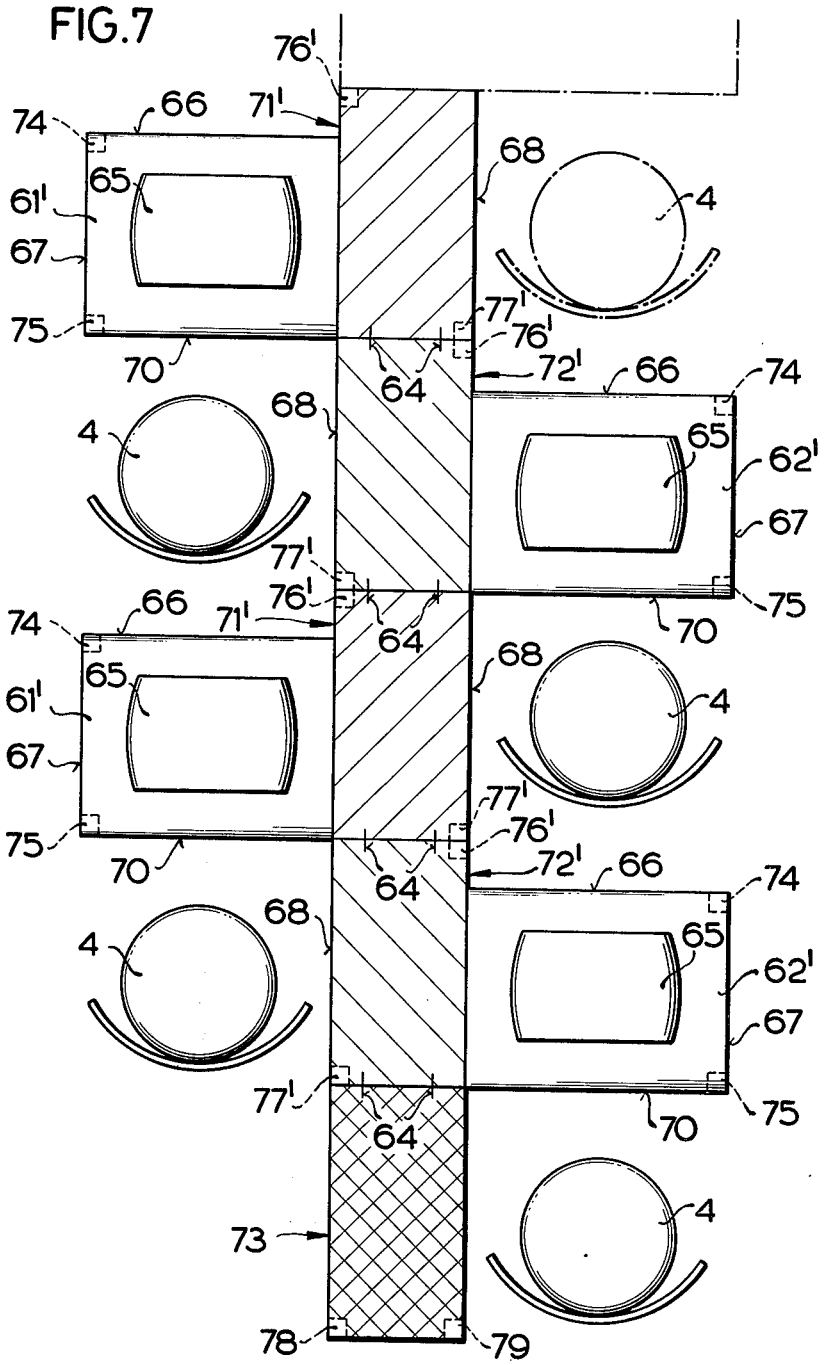

In the work unit chain illustrated in FIG. 7, the leftward extending units 61' and the rightward extending units 62' differ from those of the work unit chain shown in FIG. 6 merely in that the extensions 71' and 72', instead of being arranged on the front side 70, are arranged on the rear side 66. Also, the front edges 70 extend rectilinearly from the narrow end 67 to the opposite edges 68. This results in a somewhat different arrangement of the legs 76' and 77', as compared to the legs 76 and 77 of the tables 61 and 62, insofar as the legs 76' are now arranged on respective inner rear corners of the extensions 71', 72', and the legs 77' are arranged on the corner formed by the straight edge 70 and the front end 68.

Figure 9:
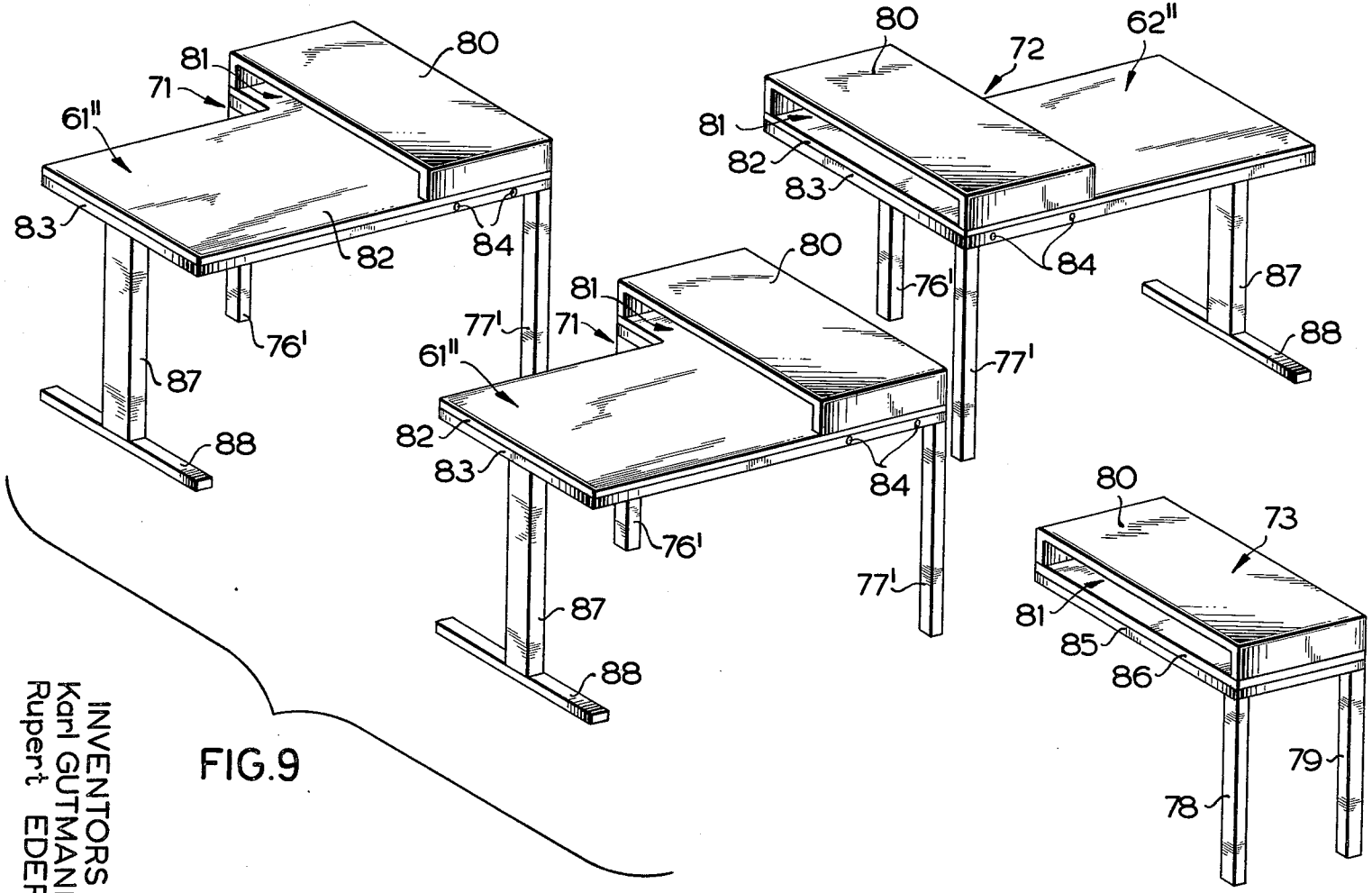
FIG. 9 is an exploded perspective view of the work unit chain shown in FIG. 7.

As can be seen from FIG. 9, which illustrates the units of FIG. 7 in perspective, the same box-shaped attachments 80, as in the embodiment shown in FIGS. 6 and 8, are also provided on the extension element 73, in FIG. 7, as well as on those surfaces of the individual units 61' and 62' forming the table band. While the units 61' and 62' of FIG. 7 are provided on the narrow end 67 with two legs 74 and 75 arranged at the corners, the tables 61'' and 62'' of FIG. 9 have, on their ends 67, only a single leg 87 extending perpendicularly from a skid 88. Otherwise, the unit construction shown in FIG. 9 corresponds essentially to that shown in FIG. 8.

Taken as a whole, the tables 61'' and 62'' shown in FIG. 9 have the same advantages and main features as the units shown in FIG. 8, as far as the formation of a work unit chain is concerned.

While specific embodiments of the invention have been shown and described in detail to illustrate the application of the principles of the invention, it will be understood that the invention may be embodied otherwise without departing from such principles.

What is claimed is:

1. A rectilinear work place unit chain comprising, in combination, a plurality of individual workplace units, for business machines such as typewriters, bookkeeping machines, and the like, each including a machine supporting substantially rectangular main table having a pair of longer sides joined by a pair of narrow edges, the main tables of successive workplace units extending laterally in opposite directions from the chain with their longer sides substantially perpendicular to the length of the chain; a plurality of substantially rectangular side tables each respective to only a single individual main table and forming a unit therewith, and having a pair of longer sides joined by a pair of narrow edges, the longer sides of said side tables extending parallel to the narrow edges of said main tables; said side tables being arranged end-to-end in a single row; each table including a table top supported on a substantially horizontal table top metal frame; respective tubular metal legs supporting each table top metal frame; the metal frame and table top of each side table having, longitudinally of said chain, slightly longer side lengths than the metal frame and table top of the associated main table; means disengageably interconnecting the narrow edges of the metal frames of said side tables; said side tables including second substantially horizontal metal frames supported on the associated metal legs in spaced relation below their table top metal frames; and respective shelves supported on each said second metal frame; the table top and shelf of each side table defining an empty inter-space opening in a lateral direction away from the associated main table; said interconnected side tables defining a continuous rectilinear table band extending substantially centrally between said main tables with each said empty inter-space being laterally aligned with, and opening toward, a main table seating position on the opposite side of said band from the main table associated with the respective side table; the table tops of said side tables being substantially coplanar and at a level higher than the table tops of said main tables.

2. A work unit, as claimed in claim 1, in which the metal frames of the two tables of each unit are disengageably interconnected.

3. A work unit, as claimed in claim 2, in which each main table has a vertically adjustable table top.

4. A work unit, as claimed in claim 1, in which the upper metal frame of each side table comprises a tubular steel frame; a single leg extending downwardly from said tubular steel frame; and a substantially horizontally extending skid secured to the bottom end of said leg.

5. A work unit, as claimed in claim 4, in which said single leg extends downwardly from a longer side edge of said tubular frame.

6. A work unit, as claimed in claim 5, in which said skid extends substantially parallel to said longer side edge of said tubular steel frame; means, including horizontally extending second skids supporting each main table; each side table supporting skid extending in adjacent parallel relation with a second skid; and means disengageably interconnecting each pair of adjacent parallel skids.

7. A work unit, as claimed in claim 5, in which said leg is disengageably connected with said longer side edge of said tubular steel frame nearer to one end of said longer side edge than to the other end thereof.

8. A work unit, as claimed in claim 7, in which the supporting means for each main table includes a leg extending upwardly from a second skid and connected to a narrower end edge of a frame, forming part of said metal frame, supporting a table top of said main table; the leg of each side table extending in adjacent parallel relation to a leg of the associated main table; and means disengageably interconnecting the leg of each side table to the adjacent parallel leg of the associated main table.

9. A work unit, as claimed in claim 7, including a pair of spaced bars welded to the underside of said tubular steel frame and arranged to embrace the upper end of said legs; said bars being arranged to be bolted to the upper end of said leg.

10. A work unit, as claimed in claim 7, including a pair of angle plates bolted to the underside of said tubular steel frame in spaced relation to embrace the upper end of said leg; said angles being arranged to be bolted to the upper end of said leg.

11. A work unit, as claimed in claim 1, including connecting elements interposed between the upper frame end edges of adjacent side tables and disengageably connected to the frame end edges.

12. A work unit, as claimed in claim 1, in which said shelf is movably mounted on said second metal frame.

13. A work unit, as claimed in claim 1, in which each side table has a table top formed with at least one cutout therethrough, and having supporting bars extending across each cutout beneath the table top to support additional equipment seated in each cutout.

14. A work unit, as claimed in claim 1, in which each side table has a table top provided with partitions extending substantially perpendicularly upwardly therefrom.

15. A work unit, as claimed in claim 1, in which each main table has a tiltable table top.

16. A work unit, as claimed in claim 3, in which said table top is tiltable.

* * * * *